US006779308B2

(12) United States Patent
Cabanne et al.

(10) Patent No.: US 6,779,308 B2
(45) Date of Patent: Aug. 24, 2004

(54) SYSTEM FOR ASSEMBLING A MOBILE ELEMENT IN A HOUSING

(75) Inventors: Damien Cabanne, Fontainebleau (FR); Mark Lawrie, Sully-sur-Loire (FR); Yann Le Gallo, Orleans (FR); Pascal De Vries, Sandillon (FR); Klaus Blume, Haan (DE); Charles Hopson, Lebanon, TN (US); Hervé Laurandel, Herouville (FR); Simon Dobson, Folkstone (GB)

(73) Assignee: Meritor Light Vehicle Systems France (FR)

( * ) Notice: Subject to any disclaimer, the term of this patent is extended or adjusted under 35 U.S.C. 154(b) by 195 days.

(21) Appl. No.: 09/895,832

(22) Filed: Jun. 29, 2001

(65) Prior Publication Data

US 2002/0062599 A1 May 30, 2002

(30) Foreign Application Priority Data

Jul. 3, 2000 (FR) ..... 00 08585

(51) Int. Cl.[7] ..... E05F 11/48
(52) U.S. Cl. ..... 49/352; 49/348
(58) Field of Search ..... 49/352, 348, 502, 49/360, 374, 349, 372; 296/146.7, 146.2, 146.1, 146.3, 146.5

(56) References Cited

U.S. PATENT DOCUMENTS 4,235,046 A * 11/1980 Hess et al. ..... 49/352
4,753,125 A * 6/1988 Fukumoto et al. ..... 49/352
4,840,080 A * 6/1989 Kobayashi et al. ..... 49/352 X
5,040,430 A * 8/1991 Adam et al. ..... 49/349 X
5,044,222 A * 9/1991 Tanaka et al. ..... 49/352
5,511,443 A * 4/1996 Munekhoff ..... 49/352 X
5,773,947 A * 6/1998 Torii et al. ..... 296/223 X
6,051,901 A * 4/2000 Ishida ..... 49/280 X
6,125,585 A * 10/2000 Koneval et al. ..... 49/352 X
6,405,484 B1 * 6/2002 Butler ..... 49/246
6,408,572 B1 * 6/2002 Uchimura et al. ..... 49/352

FOREIGN PATENT DOCUMENTS

| | | |
|---|---|---|
| DE | 30 08 296 A | 9/1981 |
| DE | 33 25 837 A | 2/1985 |
| DE | 196 09 252 C | 1/1997 |
| DE | 196 19 087 | 11/1997 |
| DE | 197 05 054 A | 8/1998 |
| FR | 2 773 194 A | 7/1999 |

OTHER PUBLICATIONS

INPI Preliminary Search Report dated Mar. 15, 2001.

* cited by examiner

*Primary Examiner*—Hugh B. Thompson, II
(74) *Attorney, Agent, or Firm*—Carlson, Gaskey & Olds

(57) ABSTRACT

A housing structure for a mobile element, such as a regulator drum, includes a dish that covers the housing and a backing plate with an opening large enough to accommodate the mobile element and one or more pliable tongues extending into the opening. The tongues hold the mobile element in the housing while still allowing the element to be removed without dismantling the housing or the element.

15 Claims, 1 Drawing Sheet

SYSTEM FOR ASSEMBLING A MOBILE ELEMENT IN A HOUSING

This application claims priority to French Application FR 00 08585 filed Jul. 3, 2000.

BACKGROUND OF THE INVENTION

The present invention relates to a system for assembling and holding a mobile element of a system for driving a mobile closure, in a housing made in a pre-formed sheet metal plate, and more particularly to a system for assembling and holding the drum of a window regulator of an automobile vehicle in its housing.

At the present time, the drums are housed within their covers and are held in their housing by imprisonment between the motor and the cover.

There are several drawbacks, for example if it is desired to dismantle the motor in the event of malfunctioning, the drum is no longer held in its housing. Another drawback is that it is not possible to assemble the window regulator on the door independently of the motor.

In Patent Application DE 19619087 A1 to Brose, the drum is imprisoned between the cover and the supporting sheet metal of the vehicle.

The motor may in that case be dismantled without dismantling the drum, but in that case, the window regulator cannot be transported as a complete entity, for example, between two assembly operations, as the cover must be assembled on the door panel, otherwise the drum is free and can be disengaged from its cover, this increasing the work load of the manipulators and reducing the flexibility of the organization of assembly.

DE 33 25 837 discloses a window regulator drum contained in a casing composed of two parts, of which one is made of plastics material and the other is made of sheet metal and comprises tongues which envelop the edge of the first part in order to ensure connection thereof. These tongues do not hold the drum in the housing of the casing.

It is an object of the invention to prevent the drum from escaping from its housing.

SUMMARY OF THE INVENTION

The invention attains its object in that the mobile element is assembled and held captive in its housing by means of at least one pliable tongue formed in the pre-formed plate.

The invention is advantageously applied to a vehicle window regulator incorporating cables, in which the mobile element is a drum for winding cables.

This has the advantage of allowing easy transport of the cover/drum sub-system, as well as hold of the drum in its housing in the case of dismantling the motor for example.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
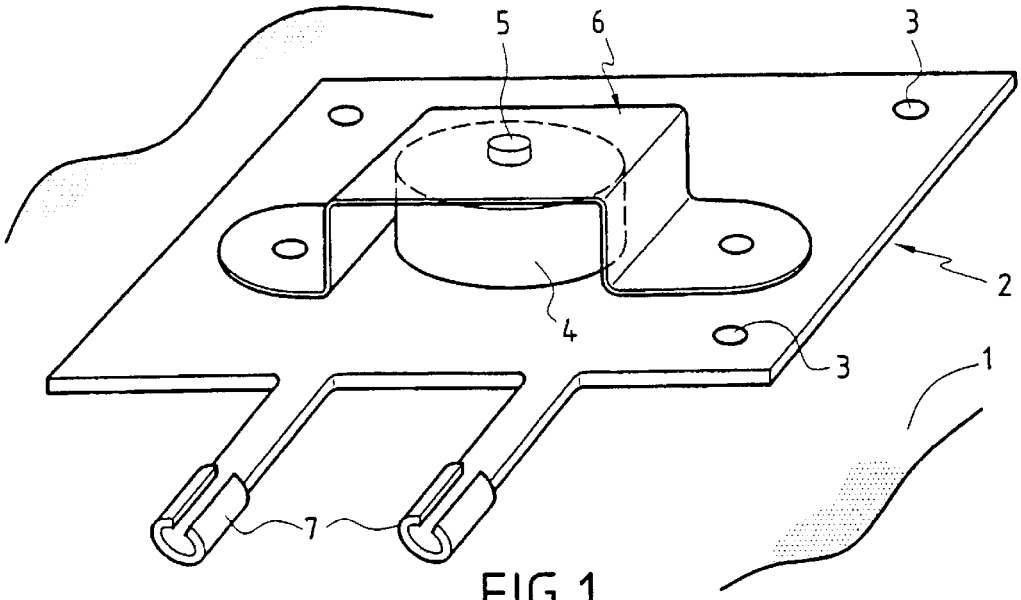
FIG.1 PRIOR ART
FIG. 1 represents a system according to the prior art in perspective.

Referring now to the drawings, FIG. 1 represents the prior art. It shows the supporting plate 1 of the door of a vehicle, on which is secured a principal metallic plate 2 via screws or rivets 3. It also shows the drum 4 which is mounted in rotation on the shaft 5 and is maintained in position thanks to a cover 6 itself secured on the principal plate 2.

Extensions 7 of the principal plate 2 have been shaped and bent to form supports of pipes for the cables maneuvering the window (not shown in the drawings).

Figure 2:
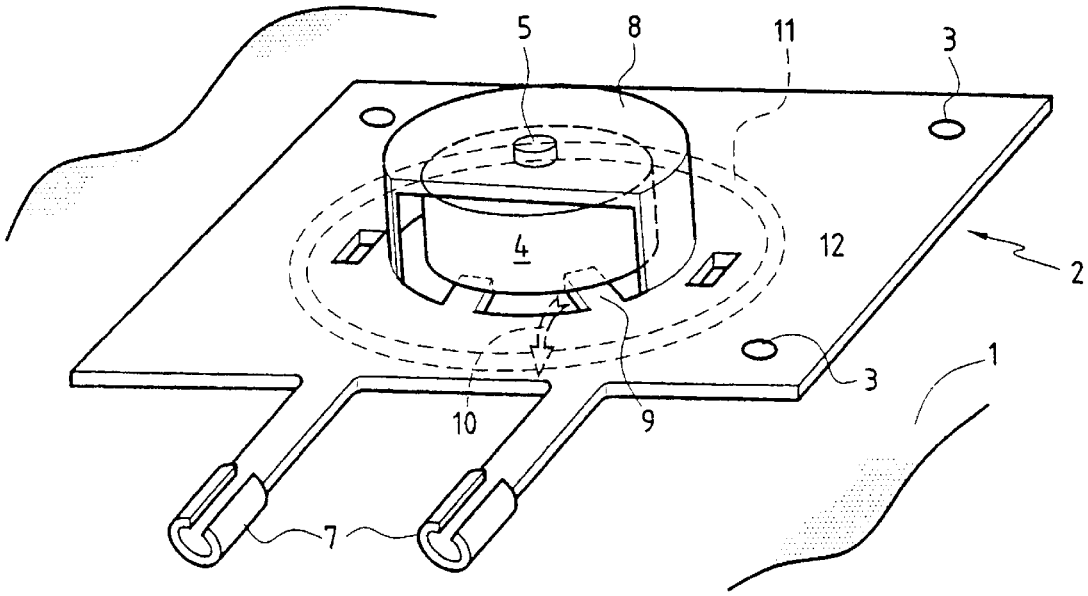
FIG. 2 represents a system according to the invention in perspective.

FIG. 2 shows a view of a system according to the invention in which the elements identical to those of FIG. 1 bear the same references.

The metallic plate 2 is stamped and cut out in order to make a housing for the drum 4 and at least one tongue 9 in the opening of the housing. The housing is defined by a U-shaped dish which presents lateral openings in particular for the passage of the cables.

The tongues 9 are formed by the lateral openings made during the cut-out and stamping operations. The bearing of the shaft 5 of the drum is also made during the stamping operation. The geometry of the dish 8 is not limiting. The only condition to be respected is that the drum 4 be maintained in position in its housing by the shaft 5 and at least one tongue 9.

This tongue 9 is pliable, being deformed in the direction of arrow 10 (downwardly) to allow passage of the drum 4, and the tongue 9 is then returned into position to hold the drum 4 in the housing between this tongue 9 and the U-shaped dish 8. The drum 4 is in that case captive, which facilitates transport of the elements and the exchange of the motor if needed.

An O-ring 11 may be positioned beneath the plate 2, thus obtaining an assembly which may be easily manipulated.

Holes 12 may be made on the plate 2, which will serve to house the elements for holding a manual drive system, for example a brake jacket in the case of a manual window regulator. Such holes will advantageously be placed within the perimeter of the O-ring, in order to guarantee seal of the system in the case of a motorized or manual window regulator, which will make it possible to have a single part 2 whether it be for a manual or electric window regulator.

It will be noted that this system reduces the number of components by combining the components 1 and 6 of the prior art.

A preferred embodiment of this invention has been disclosed. However, a worker of ordinary skill in this art would recognize that certain modifications would come within the scope of this invention. For that reason, the following claims should be studied to determine the true scope and content of this invention.

What is claimed is:

1. A housing for a mobile element of a drive system, comprising:

a cover adapted to hold the mobile element;

a plate attached to the cover, wherein the plate has an opening substantially aligned with the cover; and at least one pliable tongue integrally formed with the plate and extending into the opening, wherein said at least one pliable tongue is pressed toward the cover to retain the mobile element substantially in the cover.

2. The housing of claim 1, wherein at least one of the plate and the cover is made of metal.

3. The housing of claim 1, wherein the plate, cover and pliable tongue are integrally formed together from a single piece of material.

4. The housing of claim 1, wherein at least one hole is formed in the plate to accommodate a manual drive system.

5. The housing of claim 1, further comprising at least one extension extending from the plate, wherein said at least one extension forms at least one pipe adapted to accommodate a cable.

6. The housing of claim 1, further comprising an O-ring attached to the plate.

7. A drive assembly, comprising:

a mobile element;

a cover holding the mobile element;

a plate attached to the cover, wherein the plate has an opening substantially aligned with the cover; and at least one pliable tongue integrally formed with the plate and extending into the opening, wherein the pliable tongue is pressed toward the cover to retain the mobile element substantially in the cover, wherein the cover and the plate together form a housing for the mobile element.

8. The drive assembly of claim 7, wherein at least one of the plate and the cover is made of metal.

9. The drive assembly of claim 7, wherein the plate, cover and tongue are integrally formed together from a single piece of material.

10. The drive assembly of claim 7, wherein at least one hole is formed in the plate to accommodate a manual drive system.

11. The drive assembly of claim 7, further comprising at least one extension extending from the plate, wherein said at least one extension forms at least one pipe adapted to accommodate at least one cable attached to the mobile element.

12. The drive assembly of claim 7, further comprising an O-ring attached to the plate.

13. The drive assembly of claim 7, wherein the mobile element is a drum.

14. The drive assembly of claim 7, further comprising a supporting plate attached to the plate by at least one fastener.

15. The drive assembly of claim 14, wherein said at least one fastener is selected from the group consisting of a screw and a rivet.

* * * * *